United States Patent [19]

Shigeta et al.

[11] B 3,991,856

[45] Nov. 16, 1976

[54] ELEVATOR CABLE OSCILLATION-ABSORBING DEVICE

[75] Inventors: Masayuki Shigeta, Katsuta; Tadashi Shibata, Naka; Toshihiko Nara, Katsuta, all of Japan

[73] Assignee: Hitachi, Ltd., Japan

[22] Filed: Jan. 25, 1974

[21] Appl. No.: 436,724

[44] Published under the second Trial Voluntary Protest Program on February 24, 1976 as document No. B 436,724.

[30] Foreign Application Priority Data

Jan. 29, 1973 Japan ..... 48-11054

[52] U.S. Cl. ..... 187/1 R; 174/42; 267/136

[51] Int. Cl.[2] ..... B66B 7/06

[58] Field of Search ..... 187/94, 23, 22, 20, 187/17, 1 R, 1 A; 24/122.6, 129 D; 248/63, 258; 174/42, 146; 188/1 B; 343/DIG. 1; 267/136, 141

[56] References Cited

UNITED STATES PATENTS

| | | | |
|---|---|---|---|
| 2,227,528 | 1/1941 | Adler | 174/42 X |
| 2,889,011 | 6/1959 | Weaver | 174/42 X |
| 3,246,073 | 4/1966 | Bouche et al. | 248/358 R |
| 3,291,892 | 12/1966 | Bethea | 174/42 |
| 3,448,222 | 6/1969 | Greber | 174/42 |
| 3,653,467 | 4/1972 | Showalter | 187/22 |

FOREIGN PATENTS OR APPLICATIONS

| | | | |
|---|---|---|---|
| 1,406,220 | 10/1968 | Germany | 187/20 |
| 1,431,865 | 11/1968 | Germany | 187/1 R |

*Primary Examiner*—Blunk, Evon C.
*Assistant Examiner*—James L. Rowland
*Attorney, Agent, or Firm*—Craig & Antonelli

[57] ABSTRACT

In an elevator including weight-compensating ropes having their respective one end connected to the lower end of a car and the other end thereof connected to the lower end of a counterweight, an oscillation-absorbing device is provided closely adjacent to at least one of a first connecting portion of the main ropes to a car or the counterweight and a second connecting portion of the weight-compensating ropes to the car or counterweight, thereby absorbing oscillation energy from ropes.

12 Claims, 11 Drawing Figures

ELEVATOR CABLE OSCILLATION-ABSORBING DEVICE

This invention relates to an elevator, wherein ropes having their respective one end connected to a car and the other end thereof connected to a counterweight are wound or unwound by a winch for ascending or descending movement, and more particularly to an elevator moving at a high speed yet over a long travel.

Recently, due to amazing progress in building construction techniques, an increase in the construction of multi-stories buildings has resulted. This stimulates a demand for the use of an elevator, specially a demand for such an elevator which has an increased length of travel and is operated at a high speed, so as to improve the efficiency of transfer of passengers or baggages. Such multi-stories buildings, because of the flexible construction to cope with earthquake, are susceptible to the lateral oscillation in the event of earthquake or strong wind.

On the other hand, in an elevator of the type in which the main ropes suspend a car and a counter-weight through springs, and the weight-compensating ropes have their respective one end connected to the lower end of the car and the other end connected to the lower end of the counterweight, the main ropes and weight-compensating ropes present uneven physical constants and the springs interconnecting the car and counterweight with ropes present uneven physical constants, such that the phase and frequency of lateral oscillation in ropes are not uniform throughout the entire ropes.

Such a lateral oscillation in ropes, once it happens, lasts for a long period of time because of the ropes being inherently low in internal damping capability. If the car and counterweight travel at a high speed, with the ropes being still subjected to the lateral oscillation, there will be increased a risk of the ropes of coming off the grooves of a pulley of a winch or the like, or even if the ropes do not come off the grooves, such a lateral oscillation in ropes causes an abnormal oscillation in the car, whereby passengers may feel uneasy. Such a risk and a feeling of uneasiness will be incurred increasingly with the increase in a travelling speed of an elevator.

Hitherto, U.S. Pat. No. 3,666,051 has been proposed for preventing the lateral oscillation in ropes. In the method disclosed in said Patent, a device for stabilizing ropes is provided midway of the travelling path of an elevator, and such a device is so designed as to be picked up on the car when it moves upwardly. Such a method certainly meets an intended purpose so far as the device is used in an elevator which travels at a low speed. However, if the device is used in an elevator which travels at a high speed of more than 200 m/min., the collision of the car with the aforesaid stabilizing device will be accompanied by a considerable level of impact, coupled with a high impact sound, and hence the device is impractical for use in a high speed elevator. The aforesaid stabilizing device is composed of rollers placed in squeezing relation to ropes, such that the relative oscillation in ropes may be effectively controlled only in a portion where the device is mounted, whereby the oscillation energy in ropes may not be absorbed over the entire length thereof.

Securing the ropes to a wooden plate or block to connect with each other, may be proposed for preventing the lateral oscillation in ropes, but this will not effect absorption of the oscillation energy but variation in the frequency of the lateral oscillation.

It is accordingly an object of the present invention to provide a device which permits to prevent a car and a counterweight from being subjected to a lateral oscillation due to ropes laterally oscillating resulting from the lateral oscillation of a building.

To attain the object described, the present invention is directed to providing an elevator which comprises a winch provided in a machine room, a plurality of main ropes trained about a pulley of the winch, a car and a counterweight suspended by the plurality of main ropes trained about said pulley and ascending or descending by means of the main ropes, a plurality of weight-compensating ropes having their respective one end connected to the lower end of said car and the other end thereof connected to the lower end of counterweight, and an oscillation-absorbing device provided closely adjacent to at least one of a first connecting portion of the main ropes to the car or counterweight and a second connecting portion of the compensating ropes to the car or counter-weight so as to absorb oscillation energy from ropes.

Another object of the present invention is to provide a device of the type which is simple in construction and easy in maintenance and check.

A further object of the present invention is to provide a device of the type, wherein in providing the aforesaid oscillation-absorbing device in an elevator, spacings between the floor of machine room and car and counterweight are not substantially large.

FIG. 1 is a longitudinal elevation view of a travelling path of an elevator of the present invention;

FIGS. 2*a* and 2*b* are cross-sectional views taken along the line II — II of FIG. 1, wherein FIG. 2*a* illustrates two rows of ropes arranged in parallel relation, and FIG. 2*b* shows a single row of ropes;

Figure 1:
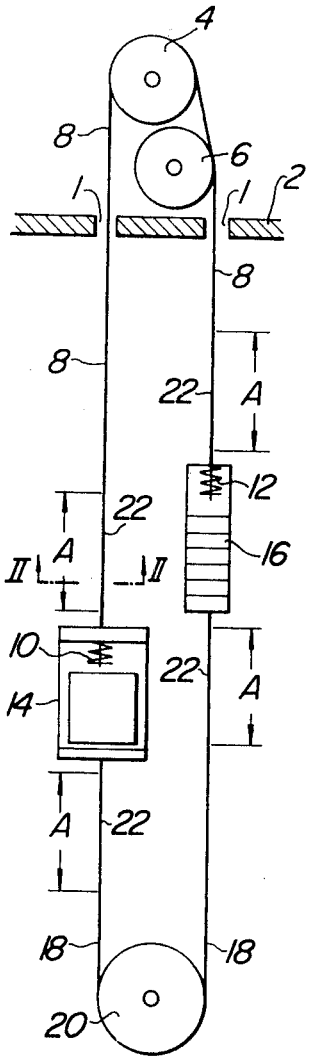

Referring now to FIG. 1, a plurality of main ropes 8 are trained about a pulley of a winch 4 which is set on the floor of a machine room and used in driving an elevator and then around a deflecting pulley 6, and the ropes 8 run through holes 1 provided in the aforesaid floor. A car 14 and a counterweight 16 are suspended by way of coil springs 10 and 12 from the opposite ends of a plurality of main ropes 8. To prevent the variation in load exerted on the winch 4 depending upon the varying position of the car, a plurality of ropes 18 are connected by way of a deflecting pulley 20 to the lower end of the car 14 and that of the counterweight 16, said plurality of ropes serving for compensating for the weight of a plurality of main ropes 8. There are provided connecting portions 22 having a length A adjacent to connecting positions of a plurality of main ropes 8 or compensating ropes 18, so that the connecting portions 22, if the car 14 and the counterweight 16 go up or down over the entire length of travel, may not reach the winch 4 and deflecting pulleys 6 and 20.

Figure 2A:
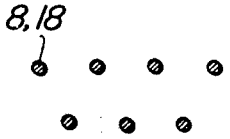
Figure 2B:
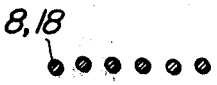
Figure 3:
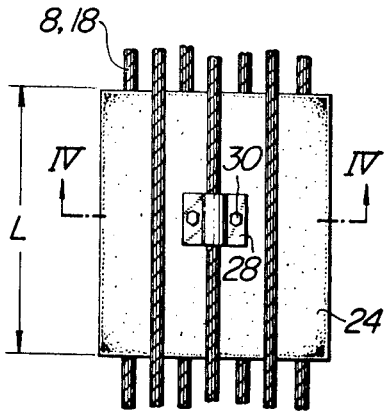
FIG. 3 illustrates an oscillation-absorbing device according to an embodiment of the present invention, which is shown attached between two rows of ropes arranged in parallel relation.
Figure 4:
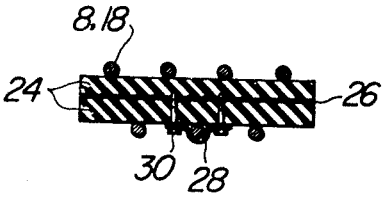
FIG. 4 is a cross-sectional view taken along the line IV — IV of FIG. 3.

Usually, the main ropes 8 and the compensating ropes 18 are arranged either in two-row parallel relation or in a single row, as shown in FIG. 2*a* or 2*b*. In case the ropes are arranged in two-row parallel relation, a sheet-like resilient member 24 having a length L is inserted between two rows of ropes arranged in parallel relation but closely adjacent to each of the aforesaid connecting portions 22 in a manner to provide contacting engagement with respective ropes, with a supporting member 26 being contained inside the resilient member 24. The resilient member 24 and supporting member 26 are rigidly fastened to any one of ropes by means of a metal piece 28 and bolts 30.

In the event that the lateral oscillation is caused in the ropes 8 and 18, resulting from the lateral oscillation in a building due to earthquake or strong wind, the sheet-like resilient member 24 interposed between two rows of ropes will be subjected to deformation since said resilient member is maintained in contacting engagement with ropes, thereby absorbing oscillation energy from ropes over the entire length thereof. In this respect, even if there occurs different rate of lengthwise expansion or contraction in ropes, such an expansion or contraction in ropes may be permitted freely since the resilient member 24 is rigidly secured to only one rope, while the member 24 remains in contact with other ropes.

Figure 5:
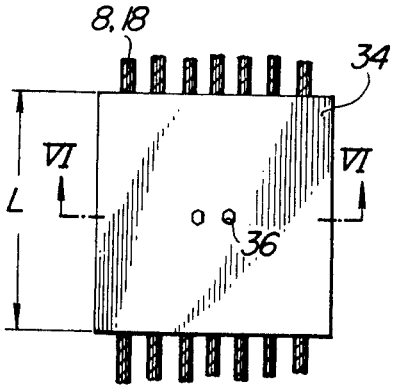
FIG. 5 illustrates a condition of the oscillation-absorbing device attached to a single row of ropes.
Figure 6:
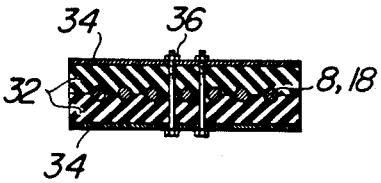
FIG. 6 is a cross-sectional view taken along the line VI — VI of FIG. 5.

FIGS. 5 and 6 show the oscillation-absorbing device attached to the ropes arranged in series relation. A sheet-like resilient member 32 having a length L encompasses a plurality of ropes 8 or 18 therewith. The resilient member 32 has supporting members 34 provided on outer surfaces thereof. Thus, the resilient member 32 is rigidly secured to any one of ropes by fastening the supporting members 34 by means of bolts 36. In this case, it is recommendable that the resilient member 32 be rigidly secured to one of a plurality of ropes (in the drawing, a central rope) and maintained in loosely engaging relation with the other ropes. Likewise in this embodiment, the resilient member 32 will be subjected to deformation due to the lateral oscillation in ropes, thereby absorbing oscillation energy from ropes.

The resilient member 24 or 32 used in either of the embodiments described is so designed that the lateral oscillation in ropes is converted to the deformation of the resilient member itself, so as to allow the resilient member to absorb the oscillation energy from ropes, and hence such a resilient member should be preferably made of a material of high resiliency, such as soft rubber, a foamed material having an ample resiliency, or the like. The resilient member should preferably be as long as possible and may be of a split type.

In the aforesaid two embodiments, the resilient members 24 and 32 are secured to ropes by means of supporting members 26, 34. However, the supporting members 26 and 34 may be omitted. However, the use of the supporting members ensures the positive attachment of the resilient members to ropes, while the separation of resilient members can advantageously be avoided. The supporting members may be made of materials of suitable rigidity, such as steel, aluminum plate, etc.

As is apparent from the foregoing description, the features of the above-described two embodiments exist in that the oscillation-absorbing device is inserted between ropes or encloses ropes therewith in contacting engagement with these ropes, and is located in at least one of a first connecting portion of the main ropes to the car and counterweight and a second connecting portion of the compensating ropes to the car or counterweight. With such arrangements, the aforesaid oscillation-absorbing devices can absorb oscillation energy from ropes over the entire length thereof, and in addition, even if the ropes are considerably long, the oscillation-absorbing device efficiently serves to prevent the increase in the lateral oscillation in such ropes, while such an increase is caused by the resonance of such ropes with the oscillation cycle of a building. The attachment of the oscillation-absorbing device to the rope is achieved with ease by inserting same between ropes arranged in two-row parallel relation or by encompassing the ropes therewith, with said device being secured to one of ropes by means of bolts, such that the maintenance and check are quite easy. Furthermore, because the oscillation-absorbing device is attached to a rope closely adjacent to the aforesaid connection portion, the oscillation-absorbing device has no connection to a top allowance of ropes required for the safety sake when the car and counterweight reach the upper limit of travel.

Figure 7:
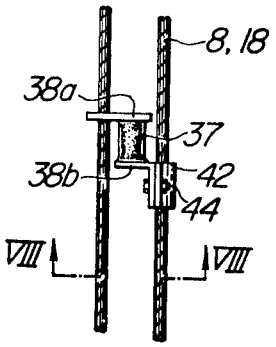
FIG. 7 illustrates a condition of an oscillationabsorbing device according to another embodiment of the present invention, which is shown attached between ropes.
Figure 8:
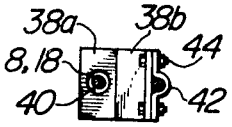
FIG. 8 is a cross-sectional view taken along the line VIII — VIII of FIG. 7.

A further embodiment will hereunder be referred to, in conjunction with FIGS. 7 and 8.

In the drawings, there is provided a resilient member 37 between an upper seat 38*a* and a lower seat 38*b*, said resilient member being made of a rubber-like material or a porous material which is large in internal damping capability. Each of the upper seat 38*a* and lower seat 38*b* is connected to a separate rope 8 or 18, closely adjacent to the connecting portion 22. The upper seat 38*a* is provided with a through-hole 40 having a diameter larger than that of the rope 8 or 18, through which one rope runs loosely. The lower seat 38*b* is fixedly secured to the other rope by means of a metal piece 42 and a bolt 44.

In the event that the lateral oscillation of a building is caused due to earthquake or strong wind, the connecting portions and their vicinities of ropes 8 and 18 may oscillate in a lateral direction due to the deformation of the resilient member 37, and so far as the relative oscillation in ropes 8 and 18 causes the deformation of the resilient member 37, the oscillation energy in ropes over the entire length thereof may be absorbed by the resilient member, with the result that the lateral oscillation of ropes may be eliminated to a stable condition, immediately. The relative expansion or contraction of respective ropes 8 and 18 may be accommodated by the upper seat 38*a* which loosely receives the ropes therein. Naturally, as many resilient members 37 should preferably be provided between ropes as possible. The resilient members disposed closely adjacent to all of four portions present more favorable effect.

The features of the embodiment is such that the oscillation-absorbing device is provided in at least one of the connecting portions of the ropes 8 and 18, where the car or counterweight is connected, said oscillationabsorbing device having the upper and lower ends connected to a separate rope and being adapted to be deformed in a manner to accommodate the varying spacing between ropes. With such arrangements, the oscillation-absorbing devices may completely absorb the oscillation energy from ropes over the entire length thereof. It is preferable that the oscillation-absorbing device be of a dimension which permits its passage through the holes which are provided in the floor of machine room for passing ropes therethrough. An oil damper may be used as the oscillation-absorbing device in place thereof.

Figure 9:
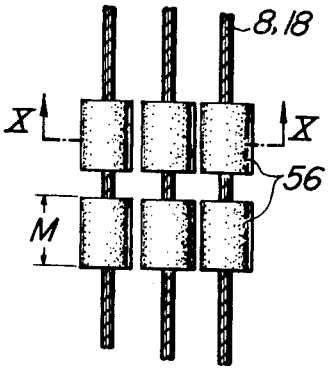
FIG. 9 is an oscillation-absorbing device according to a further embodiment of the present invention, which is shown attached between ropes; and, FIG. 10 is a cross-sectional view taken along the line X — X of FIG. 9.
Figure 10:
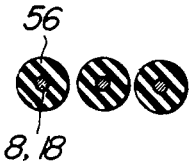

FIGS. 9 and 10 show a still further embodiment of the present invention, wherein a plurality of tubular resilient members 56 each having a length M are arranged, with respective ropes piercing therethrough. An outer diameter of each resilient member 56 is such that the mutual resilient members are brought into contact with each other when the ropes are subjected to the lateral oscillation. The resilient member 56 should be preferably made of rubber having a hardness from 30 to 40%.

What is claimed is:

1. Apparatus comprising:

a first load member, a second load member spaced from said first member, a plurality of flexible line members extending in side by side relationship to one another from said first load member to said second load member with one end of each of said line members being attached to said first load member and the other opposite end of each of said line members being attached to said second load member, moving means for moving said line members together with said first and second load members, and oscillation-absorbing means for absorbing lateral oscillations of said line members, said absorbing means being connected to a first of said line members for movement both laterally and longitudinally with said first line member, said absorbing means being resiliently engageable with a second of said line members while permitting relatively free longitudinal movement of said second line member with respect to said absorbing means and said first line member, whereby absorption of lateral oscillations in said first and second line members by said absorbing means is obtained while permitting free relative longitudinal movement of said first and second line members to accommodate for different rates of longitudinal expansion and the like, wherein said absorbing means includes a relatively flat sheet of resilient material disposed to have a plurality of said line members in lateral contact therewith at both opposite sides thereof with only said first line member attached thereto for both lateral and longitudinal movement therewith.

2. Apparatus according to claim 1, wherein more than two of said line members are provided, and wherein all of said line members other than said first line member are positioned for resilient lateral engagement with said absorbing means while being freely movable with respect to one another and said absorbing means in the respective longitudinal direction thereof.

3. Apparatus according to claim 2, wherein said first load member is an elevator car and said second load member is an elevator counterweight, said car and counterweight being supported by line means attached thereto and extending over a first pulley, and wherein said moving means includes means for moving said line means.

4. Apparatus according to claim 2, wherein said first load member is an elevator car and said second load member is an elevator counterweight, said plurality of flexible line members being one of main ropes trained about a winch and supporting said car and counterweight and weight compensating ropes having their ends attached to the respective lower ends of said car and counterweight.

5. Apparatus according to claim 4, wherein said absorbing means is attached to said first line member at a position adjacent one of said car and counterweight and remote from respective supporting pulleys for said line members.

6. Apparatus according to claim 5, wherein said absorbing means is a relatively flat sheet of resilient material supported by a supporting member of relatively rigid material.

7. Apparatus comprising:

a first load member, a second load member spaced from said first member, a plurality of flexible line members extending in side by side relationship to one another from said first load member to said second load member with one end of each of said line members being attached to said first load member and the other opposite end of each of said line members being attached to said second load member, moving means for moving said line members together with said first and second load members, and oscillation-absorbing means for absorbing lateral oscillations of said line members, said absorbing means being connected to a first of said line members for movement both laterally and longitudinally with said first line member, said absorbing means being resiliently engageable with a second of said line members while permitting relatively free longitudinal movement of said second line member with respect to said absorbing means and said first line member, whereby absorption of lateral oscillations in said first and second line members by said absorbing means is obtained while permitting free relative longitudinal movement of said first and second line members to accommodate for different rates of longitudinal expansion and the like, wherein said absorbing means is a relatively flat sheet of resilient material supported by a supporting member of relatively rigid material.

8. Apparatus according to claim 7, wherein said first load member is an elevator car and said second load member is an elevator counterweight, said car and counterweight being supported by line means attached thereto and extending over a first pulley, and wherein said moving means includes means for moving said line means.

9. Apparatus according to claim 8, wherein a second pulley is provided for guiding said plurality of line members.

10. Apparatus according to claim 8, wherein said line means includes a further plurality of flexible line members extending in side by side relationship to one another from said car to said counter-weight with one end of each of said further line members being attached to said car and the other opposite end of each of said further line members being attached to said counterweight.

11. Apparatus comprising:

a first load member, a second load member spaced from said first member, a plurality of flexible line members extending in side by side relationship to one another from said first load member to said second load member with one end of each of said line members being attached to said first load member and the other opposite end of each of said line members being attached to said second load member, moving means for moving said line members together with said first and second load members, and oscillation-absorbing means for absorbing lateral oscillations of said line members, said absorbing means being connected to a first of said line members for movement both laterally and longitudinally with said first line member, said absorbing means being resiliently engageable with a second of said line members while permitting relatively free longitudinal movement of said second line member with respect to said absorbing means and said first line member, whereby absorption of lateral oscillations in said first and second line members by said absorbing means is obtained while permitting free relative longitudinal movement of said first and second line members to accommodate for different rates of longitudinal expansion and the like, wherein said absorbing means includes resilient member having upper and lower seats provided on opposite ends of said resilient member, one of said upper and lower seats being rigidly fixed to said first line member and the other seat receiving said second line member loosely therein.

12. An elevator comprising:

a winch provided in a machine room;

a plurality of main ropes trained about a pulley of said winch;

a car and a counterweight suspended by said plurality of main ropes for ascending or descending movement by means of said main ropes and said winch;

a plurality of weight-compensating ropes having their respective one end connected to the lower end of said car and the other end thereof connected to the lower end of said counterweight; and an oscillation-absorbing device provided closely adjacent to at least one of a first connecting portion of the main ropes to the car or the counterweight and a second connecting portion of the weight-compensating ropes to the car or counterweight, thereby absorbing oscillation energy from ropes, wherein said oscillation-absorbing device has opposite ends coupled to different ropes and can be deformed in a manner to accommodate the varying spacing between ropes, thereby absorbing oscillation energy from ropes, wherein said oscillation-absorbing device is made of a resilient material high in internal damping capability, wherein said oscillation-absorbing device is composed of a resilient member and an upper and lower seats provided on opposite ends of said resilient member, said upper and lower seats engaging the ropes individually at a different level with respect to the longitudinal direction of ropes, and wherein one of said upper and lower seats is rigidly fixed to ropes, with the other seat receiving ropes loosely therein.

* * * * *